US006523520B1

(12) United States Patent
Chatterjea

(10) Patent No.: US 6,523,520 B1
(45) Date of Patent: Feb. 25, 2003

(54) ENGINE COOLING AND NOISE SUPPRESSION SYSTEM

(75) Inventor: Probir Chatterjea, Sleepy Hollow, IL (US)

(73) Assignee: Probir Chatterjea & Associates, Inc., Sleepy Hollow, IL (US)

( * ) Notice: Subject to any disclaimer, the term of this patent is extended or adjusted under 35 U.S.C. 154(b) by 0 days.

(21) Appl. No.: 09/767,010

(22) Filed: Jan. 22, 2001

(51) Int. Cl.[7] ..... F02B 77/00
(52) U.S. Cl. ..... 123/198 E; 123/41.01
(58) Field of Search ..... 123/41.01, 198 E, 123/195 C, 41.66

(56) References Cited

U.S. PATENT DOCUMENTS 5,113,819 A * 5/1992 Murakawa et al. ..... 123/198 E
5,269,264 A * 12/1993 Weinhold ..... 123/198 E
5,839,397 A * 11/1998 Funabashi et al. ..... 123/41.01
6,068,675 A * 5/2000 Tsuda et al. ..... 123/198 E
6,178,939 B1 * 1/2001 Powell ..... 123/184.21
6,192,838 B1 * 2/2001 Matsuo et al. ..... 123/41.01

* cited by examiner

*Primary Examiner*—Noah P. Kamen
*Assistant Examiner*—Jason Benton
(74) *Attorney, Agent, or Firm*—King & Jovanovic, PLC

(57) ABSTRACT

A cooling system for use in association with an engine encased within an engine compartment, having a remotely positioned cooling fan and radiator. The cooling system includes a containment member operably positioned within the engine compartment. The containment member includes an exposure opening which defines a cavity. The cooling system likewise includes a conduit associated with the containment member. The conduit includes a first end placed in fluid communication with the cavity and a second end extending outside of the engine compartment which is placed in fluid communication with the cooling fan. Circulation of the fan directs the passage of fluid from within the cavity and the conduit.

11 Claims, 2 Drawing Sheets

ENGINE COOLING AND NOISE SUPPRESSION SYSTEM

BACKGROUND OF THE INVENTION

1. Field of the Invention

The invention is directed in general to a cooling system, and more particularly to a cooling system for use in association with an engine which is encapsulated and includes a substantially remotely positioned radiator.

2. Background Art

Noise has long been a problem for heavy equipment. Indeed, as more stringent noise standards have been implemented, manufacturers have struggled to meet these standards. For example, one manner to reduce noise has been to implement an insulated engine compartment wherein the cooling heat exchangers (radiators) are moved outside of the engine compartment and generally supplemented with a fan driven by a, for example, a fixed of variable speed hydrostatic motor. The fan generally runs at as low of a speed as possible while providing adequate cooling capacity for the fluids within the various heat exchangers.

While such a system generally provides effective cooling for the fluids, certain problems have surfaced. In particular, while the cooling systems have successfully cooled the various fluids and oils, radiant heat generally remains trapped within the insulated engine compartment. As such, certain regions of the engine compartment, such as, for example, the exhaust manifolds and turbochargers remain excessively hot. This radiant heat drastically shortens the life of, among other things, alternators, electronic modules, hoses and belts.

Accordingly, it is an object of the invention to provide for a cooling system which can not only cool the various fluids but one which can also evacuate heat from particular, targeted regions within the engine compartment.

It is another object of the invention to provide for a system which further reduces noise within the engine compartment.

These and other objects of the invention will be understood in light of the claims and specification appended hereto.

SUMMARY OF THE INVENTION

The invention comprises a cooling system for use in association with an engine encased within an engine compartment. The encased engine includes a remotely positioned cooling fan and radiator. The invention includes a containment member operably positioned within the engine compartment and a conduit. The containment member includes an exposure opening which defines a cavity. The conduit is associated with the containment member. Additionally, the conduit includes a first end placed in fluid communication with the cavity and a second end extending outside of an engine compartment which is placed in fluid communication with the cooling fan. The circulation of the fan directs the passage of fluid from within the cavity and the conduit.

In a preferred embodiment, the conduit is positioned substantially in parallel with the radiator, to, in turn, preclude the passage of air from within the conduit through the radiator.

In another preferred embodiment, the containment member comprises a plurality of containment members.

In yet another preferred embodiment, the containment member includes an inlet to facilitate the ingress of air into the cavity.

Preferably, at least a portion of the cavity of the containment member includes a sound absorbing material.

The invention likewise comprises a method for cooling an engine within an engine compartment comprising the steps of providing at least one containment member, positioning the at least one containment member so as to place the exposure opening proximate a source of radiant heat, providing a conduit, associating a first end of the conduit with the at least one containment member, extending the conduit from within the engine compartment; and drawing air through the at least one containment member and through the conduit.

In one embodiment, the method further comprises the step of reducing the propagation of noise from within the engine compartment. In one such embodiment of the method, the step of reducing the propagation of noise comprises the step of positioning sound absorbing material within the cavity of the at least one containment member.

BEST MODE FOR PRACTICING THE INVENTION

Figure 1:
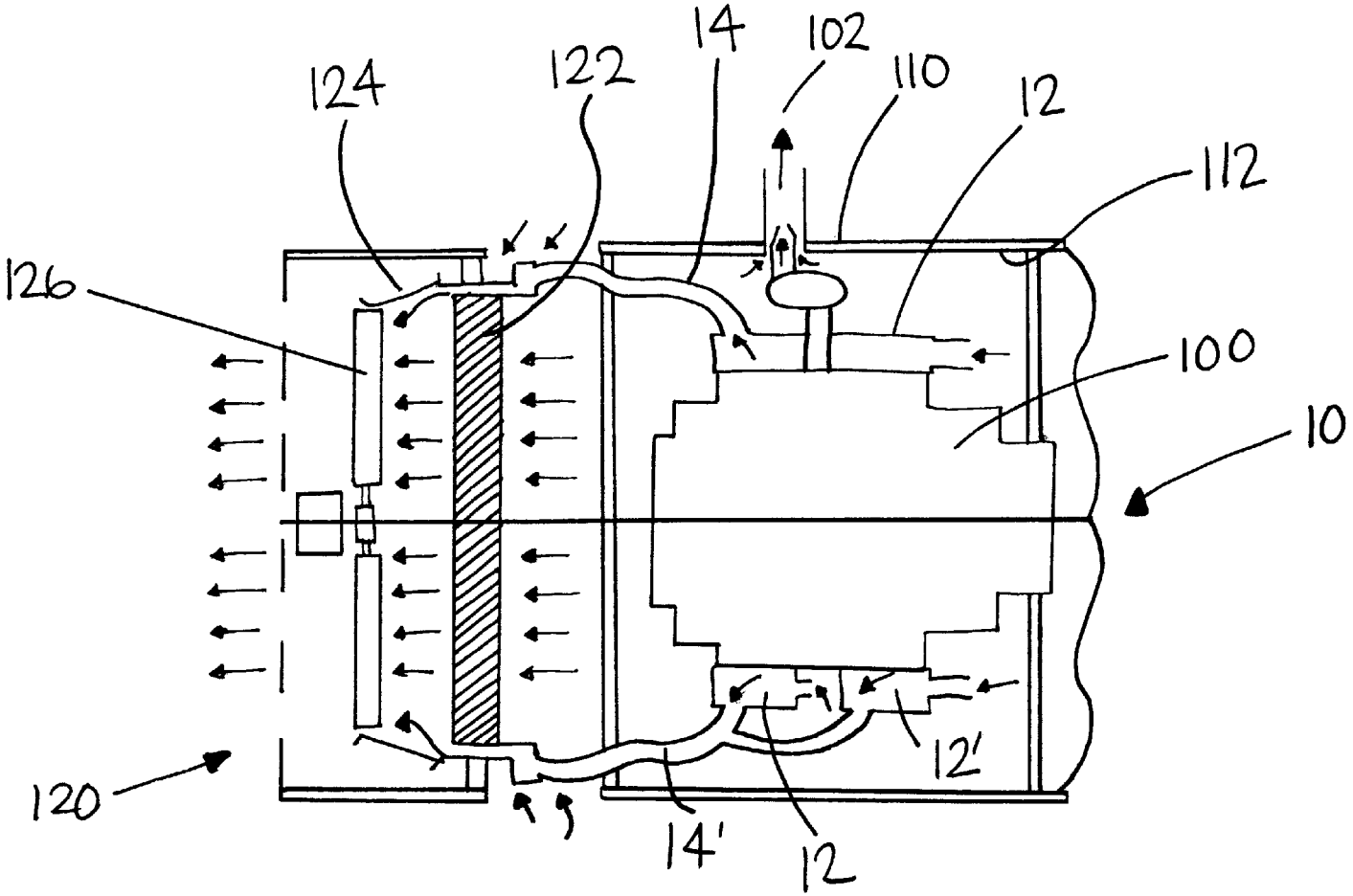
FIG. 1 of the drawings is a schematic view of an engine compartment of a construction equipment machine, such as a bulldozer, showing an embodiment of the present invention.

While this invention is susceptible of embodiment in many different forms, there is shown in the drawings and will be described in detail, one specific embodiment with the understanding that the present disclosure is to be considered as an exemplification of the principles of the invention and is not intended to limit the invention to the embodiment illustrated.

Referring now to the figures and, in particular, to FIG. 1, engine cooling and noise suppression system is shown generally as 10. Such a system is for use in association with the cooling and noise suppression of heavy construction equipment, such as, for example, bulldozers, loaders, crawlers, excavators, graders and the like. Of course, the use of such a system is not limited to such heavy construction equipment, and such an environment is solely for illustrative purposes. For example, such heavy construction equipment may include engine 100, engine compartment 110, and cooling circulation system 120. Generally, engine 100 comprises a four or six cylinder diesel engine which may be normally aspirated or turbocharged which includes exhaust 102. As shown in FIG. 1, it will be understood that a venturi exhaust wherein the exhaust gasses facilitate some evacuation of the engine compartment are contemplated for use to complement the system of the present invention.

Furthermore, engine compartment 110 may include sound deadening insulation 112 which can line the various surfaces of the engine compartment (i.e. foam encapsulation). Cooling system 120 generally includes radiator 122, shroud 124 and cooling fan 126. While other cooling means are contemplated, the cooling fan may comprise a variable speed hydraulic motor 128. Generally such a fan is driven by a belt or gear driven pump which rotates with the crankshaft of engine 100. The engine compartment is mounted remotely relative to the cooling system such that the cooling fan does not draw appreciable amounts of air from within engine compartment without the use of the system of the present invention.

In particular, and as shown in FIG. 1, engine cooling and noise suppression system 10 includes containment member 12 and a plurality of conduits, such as conduit 14. As shown in greater detail in FIG. 2, containment member 12 generally includes exposure opening 20, cavity 22, inlet 24 and exhaust 26. It will be understood that, opening 20 may have various configurations and sizes, depending on the application thereof within the system. Additionally the dimensions of cavity 22, i.e., the depth, volume, length, width and internal surface configuration, will likewise vary depending on the application. In certain embodiments, cavity 22 may include a sound absorbing material. For example, containment member may comprise a sound absorbing material, such as a foam. Similarly, cavity 22 may be lined with a sound absorbing material. Other embodiments, may omit the use of sound absorbing material.

Figure 2:
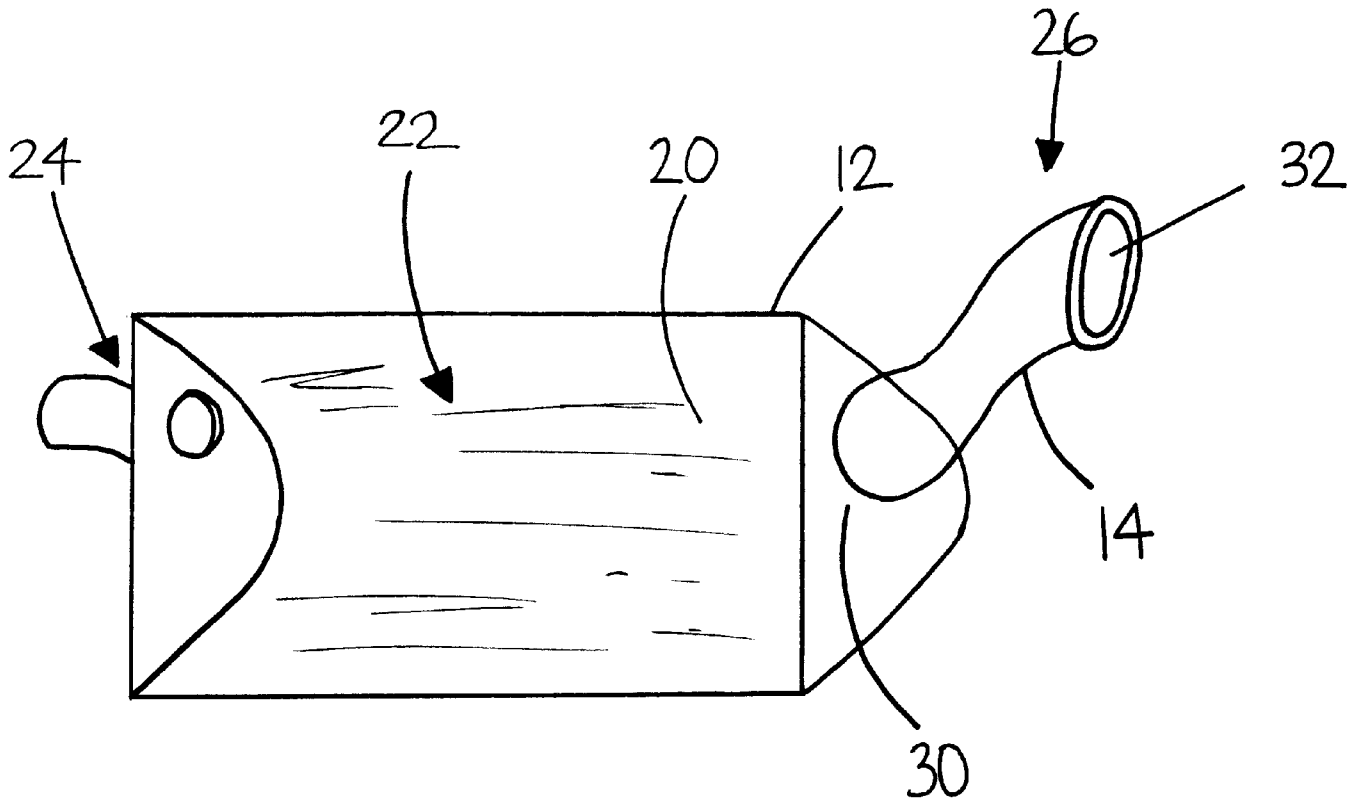
FIG. 2 of the drawings is a perspective view of a containment member of the present invention.

Likewise as shown in FIG. 2, inlet 24 comprises a port which is in fluid communication with the engine compartment, or with the air outside of the engine compartment. Exhaust 26 generally comprises an opening which corresponds to the size/shape of conduit 14. As such, conduit 14 can easily be placed in fluid communication with exhaust 26.

As shown in FIG. 1, conduit 14 includes first end 30, and second end 32. First end 30 is configured to engage exhaust 26 and second end 32 is configured to cooperate with radiator 122 and/or shroud 124 so as to place conduit 14 in fluid communication with cooling fan 126. As shown in FIG. 1, conduit 14 extends through encapsulation compartment 110. Generally conduit 14 may comprise various structures, such as, for example, a flexible, bellowed tubular material, of generally circularly cross-sectioned material, such as, for example a rubberized material, such as a silicone rubber material. Of course, conduit 14 is not limited to any particular configuration or material. With respect to the conduit, as shown in FIG. 1, two separate containment members, such as containment member 12' and 12", can merge into a single conduit 14'. Additionally, it is contemplated that a greater or fewer number of containment members can merge into a single conduit.

To prepare the system for operation, a plurality of containment members 12 and conduits 14 are supplied. At such time, the containment members are mounted proximate various components within the engine compartment proximate sources of heat so that the exposed opening extends toward the heat source. The invention is not limited to any particular type of mounting, and, such mounting may be accomplished by way of braces, brackets, adhesive, interference fits, etc. Moreover, the sources that generate the greatest amount of heat can be determined through tests, other experimentation and/or modeling.

Once the various containment members are assembled, the conduits are provided. Specifically, the first end of the conduit is associated with exhaust 26 so as to be in fluid communication therewith. Next, the conduit is extended through an appropriately sized opening within the engine compartment and drawn toward the shroud and radiator. Subsequently, the conduit is associated with the radiator and shroud so that the conduit is in fluid communication with the circulation fan. Indeed, in the embodiment shown, advantageously, the conduit extends between the shroud and the radiator, such that the two are in parallel and, in turn, such that the conduit is in direct communication with the circulation fan. As explained above, in certain embodiments, various conduits can be merged into a single conduit which then exits from within the engine compartment.

In operation, as the engine reaches operating temperature, certain regions of the engine compartment elevate in temperature, as do certain of the fluids that pass through the radiator. The hydraulic fan is directed to rotate so as to create a flow of air through the radiator. In particular, the air enters into the compartment between the engine compartment and the radiator itself. It is then drawn through the radiator and beyond the fan. At the same time, the circulation fan draws air into inlet 24 of containment member 12 which then passes through cavity 22 and out through exhaust 26, into conduit 14. The air is then drawn through the conduit and ultimately beyond the circulation fan. One particular feature is that while the conduit can be positioned so as to exhaust between the radiator and the engine compartment, by extending the conduit to the circulation fan minimizes any potentially adverse effects relative to the efficiency of the radiator. In this manner, a medium of air can be used to remove heat from within the engine compartment. Moreover, by lining the insides of the cavity with sound absorbing material, or, by constructing the cavity with sound absorbing material, noise can likewise be reduced.

In the embodiment illustrated, and additional feature may be employed to clean the radiator, the conduit and the containment members. Specifically, at predetermined times, the circulation fan can be reversed such that the flow of air through the radiator, the conduit and the containment members is reversed. This serves as an effective measure for removing debris that has accumulated within the system.

Based on calculations completed relative to modeled systems, the system will have a pronounced effect on the temperature of components within the engine compartment, and, in turn, the engine compartment itself, with very little increase in airflow from the fan. In particular, an increase in fan speed only 2%–5%, for example, will remove acceptable levels of heat from within the system.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A cooling system for use in association with an engine encased within an engine compartment, having a remotely positioned cooling fan and radiator comprising:

at least one containment member operably positioned within the engine compartment, the at least one containment member having an exposure opening which defines a cavity; and at least one conduit associated with each of the at least one containment member, the at least one conduit having a first end placed in fluid communication with the cavity and a second end extending outside of an engine compartment, and placed in fluid communication with the cooling fan, wherein circulation of the fan directs the passage of fluid from within the cavity and the conduit, wherein the cooling fan rotates such that fluid is passed from within the cavity through the conduit and ultimately beyond the cooling fan.

2. The cooling system of claim 1 wherein the conduit is positioned substantially in parallel with the radiator, to, in turn, preclude the passage of air from within the conduit through the radiator.

3. The cooling system of claim 1 wherein the at least one containment member comprises a plurality of containment members.

4. The cooling system of claim 1 wherein the at least one containment member includes an inlet to facilitate the ingress of air into the cavity.

5. The cooling system of claim 1 wherein at least a portion of the cavity of the at least one containment member includes a sound absorbing material.

6. A method for cooling an engine within an engine compartment comprising:

providing at least one containment member;

positioning the at least one containment member so as to place the exposure opening proximate a source of radiant heat;

providing a conduit;

associating a first end of the conduit with the at least one containment member;

extending a second end of the conduit from within the engine compartment;

associating the second end of the conduit with a circulating fan, wherein the fan draws air from the second end of the conduit; and drawing air sequentially through the at least one containment member and subsequently through the conduit, toward ultimate drawing beyond the circulating fan.

7. The method of claim 6 further comprising the step of:

reducing the propagation of noise from within the engine compartment.

8. The method of claim 7 wherein the step of reducing the propagation of noise comprises the step of:

positioning sound absorbing material within the cavity of the at least one containment member.

9. A cooling system for use in association with an engine encased within an engine compartment, having a remotely positioned cooling fan and radiator comprising:

a plurality of containment members, each containment member having an exposure opening which defines a cavity;

wherein the cavity is positioned to overlie a source of radiant heat within the engine compartment; and at least one conduit associated with each containment member, the at least one conduit having a first end placed in fluid communication with the cavity and a second end extending outside of an engine compartment, and placed in fluid communication with the cooling fan, wherein each containment member and associated conduit are structurally configured such that circulation of the fan draws air from proximate each source of radiant heat which is associated with each containment member, through the cavity of each containment member, through the at least one conduit associated with each containment member, ultimately beyond the cooling fan.

10. The cooling system of claim 9 wherein at least one of the containment members further includes a lining positioned within the cavity, to, in turn, absorb noise.

11. The cooling system of claim 9 wherein at least one of the containment members is structurally configured to correspond in shape to a source of radiant heat within the engine compartment.

* * * * *